US008410410B2

(12) United States Patent
Bretmersky et al.

(10) Patent No.: US 8,410,410 B2
(45) Date of Patent: Apr. 2, 2013

(54) ULTRAVIOLET LAMP SYSTEM WITH COOLING AIR CONTROL

(75) Inventors: Carl A. Bretmersky, North Olmsted, OH (US); James W. Schmitkons, Lorain, OH (US)

(73) Assignee: Nordson Corporation, Westlake, OH (US)

( * ) Notice: Subject to any disclaimer, the term of this patent is extended or adjusted under 35 U.S.C. 154(b) by 1776 days.

(21) Appl. No.: 11/457,055

(22) Filed: Jul. 12, 2006

(65) Prior Publication Data

US 2008/0017637 A1 Jan. 24, 2008

(51) Int. Cl.
*H05B 6/64* (2006.01)
*H01J 7/44* (2006.01)

(52) U.S. Cl. ..... 219/757; 315/118; 315/112

(58) Field of Classification Search ..... 219/757, 219/710, 711, 686; 392/294, 373; 315/117, 315/118; 313/12, 13
See application file for complete search history.

(56) References Cited

U.S. PATENT DOCUMENTS 4,978,891 A 12/1990 Ury
6,616,304 B2 * 9/2003 Li ..... 362/302
6,696,801 B2 2/2004 Schmitkons et al.
6,831,419 B1 12/2004 Schmitkons et al.
2004/0239256 A1 12/2004 Schmitkons et al.
2006/0037334 A1 2/2006 Tien et al.

FOREIGN PATENT DOCUMENTS

EP 0 450 131 A1 10/1991
JP 2-259356 * 10/1990
JP 02-259356 A * 10/1990
WO 02/056330 A2 7/2002
WO 2004/055863 A1 7/2004
WO 2004/102068 A1 11/2004
WO 2006/025019 A1 3/2006
WO 2006/031650 A2 3/2006

OTHER PUBLICATIONS

European Patent Office, Search Report and Written Opinion in European Application No. 07111278.3 dated Dec. 27, 2007.

* cited by examiner

*Primary Examiner* — Quang Van
(74) *Attorney, Agent, or Firm* — Wood, Herron & Evans, L.L.P.

(57) ABSTRACT

A microwave-excited ultraviolet lamp system includes a microwave chamber supplied with cooling air from an air source. At least one of a pressure sensor or a temperature sensor is positioned within the system to sense a pressure associated with the flow of cooling air or a temperature of the lamp system. A control receives a signal from the sensor and is operable to adjust the flow of cooling air from the source to obtain a desired cooling air flow rate.

9 Claims, 4 Drawing Sheets

ULTRAVIOLET LAMP SYSTEM WITH COOLING AIR CONTROL

TECHNICAL FIELD

The present invention relates generally to microwave-excited ultraviolet lamp systems, and more particularly to an ultraviolet lamp system having cooling air control.

BACKGROUND

Ultraviolet lamp systems, such as those used in the heating or curing of adhesives, sealants, inks or other coatings for example, are designed to couple microwave energy to an electrodeless lamp, such as an ultraviolet (UV) plasma lamp bulb mounted within a microwave chamber of the lamp system. In ultraviolet lamp heating and curing applications, one or more magnetrons are typically provided in the lamp system to couple microwave radiation to the plasma lamp bulb within the microwave chamber. The magnetrons are coupled to the microwave chamber through waveguides that include output ports connected to an upper end of the chamber. When the plasma lamp bulb is sufficiently excited by the microwave energy, it emits ultraviolet radiation through an open lamp face of the lamp system to irradiate a substrate which is located generally near the open lamp face.

A source of forced air is fluidly connected to a housing of the lamp system which contains the magnetrons, the microwave chamber and the plasma lamp bulb. The source of forced air is operable to direct cooling air, such as 350 CFM of cooling air for example, through the housing and into the microwave chamber to properly cool the magnetrons and the plasma lamp bulb during irradiation of the substrate by the lamp system.

In some UV heating and curing applications, the lamp system includes a mesh screen mounted at the open lamp face. The screen is transmissive to ultraviolet radiation but is opaque to microwaves. The configuration of the mesh screen also permits the significant airflow of cooling air to pass therethrough and toward the substrate.

In other applications, the substrates irradiated by the UV lamp may require a clean environment, such as in a curing chamber, so that the substrate will not be contaminated during the heating and curing process by contaminants that may be carried by the cooling air. The substrate may also be somewhat delicate and may therefore be susceptible to damage by significant flow of cooling air that would impinge upon and possibly disturb the substrate. In other applications, the substrate may also be adversely affected by excessive heat which may be generated by the plasma lamp bulb during the irradiation process. In such applications, a quartz lens has been used to protect the substrate from the flow of cooling air, while facilitating irradiation of the substrate by the lamp. Such a system is described in U.S. Pat. No. 6,831,419 to Schmitkons et al., the disclosure of which is incorporated by reference herein in its entirety.

In conventional microwave-excited UV lamp systems, cooling air is provided from a source, such as a blower, fan or other appropriate air moving device, and is supplied at a predetermined flow rate, such as about 350 CFM. The lamp system will generally include a simple, on/off-type pressure switch positioned in the air stream to ensure that an adequate flow of air is provided to cool the magnetrons and the ultraviolet lamp. In such systems, the pressure switch shuts down the UV lamp system to avoid overheating when an insufficient amount of airflow is detected. Because pressure switches are generally not very accurate, the actuation pressure of the switch is set to correspond to a flow rate that is well below the optimum operating pressure of the lamp head to ensure that system will not fault at a pressure higher than the lamp rating.

In certain applications, it is desired to adjust the power of a UV lamp system to obtain particular results, or to place the system in a "stand-by" mode. Over cooling of the UV lamp may result when the power is reduced due to the constant flow of cooling air across the lamp, which has generally been set to correspond to a particular power level of the lamp. Additive-type UV bulbs generally require temperatures that are close to the maximum allowable temperature of the bulb to ensure that the additive materials remain in the plasma and thereby produce the desired spectrum. When these additive-type systems are operated at reduced power, the bulbs can become overcooled such that the additives are not maintained in the plasma, thereby resulting in decreased efficiencies and/or undesirable results.

A need therefore exists for a UV lamp system that addresses these and other deficiencies of the prior art.

SUMMARY

The present invention provides a microwave-excited UV lamp system that is capable of controlling the flow of air provided to cool the lamp, thereby maintaining desired performance without overcooling. The system includes a housing with a microwave chamber. Forced air from a source flows through the housing and is directed to the microwave chamber to cool the UV lamp. The system further includes at least one of a pressure sensor for sensing a pressure associated with the flow of forced air, or a temperature sensor for sensing a temperature associated with the lamp system. The sensor communicates with a control that is operable to adjust the rate of flow of forced air from the source to thereby obtain a desired flow rate for the system. In one aspect of the invention, the control adjusts the flow of air as a function of a power setting of the lamp system. The adjusted flow rate may be proportional to the pressure sensed by the pressure sensor, or various other types of control may be used.

In another embodiment, the lamp system may include both a pressure sensor and a temperature sensor configured to sense a temperature associated with the lamp system. The temperature sensor may be positioned at a location where it senses a temperature associated with the temperature of the UV lamp, for example. The control may utilize signals from the pressure sensor, the temperature sensor, or both to effect a control of the flow rate of cooling air from the air source. In another aspect of the invention, the control may selectively adjust the flow of cooling air from the source between a maximum value and a non-zero minimum value. In yet another aspect, the control may selectively shut off the lamp system, for example, when the pressure sensed by the pressure sensor and/or the temperature sensed by the temperature sensor reaches a predetermined value.

In another aspect of the invention, a method of operating a microwave-excited UV lamp system includes providing cooling air to a housing of the lamp system, sensing at least one of a pressure associated with the cooling air or a temperature associated with the lamp system, and adjusting the rate of flow of the cooling air based on the sensed pressure or temperature.

These and other features, advantages, and objectives of the invention will become more readily apparent to those of ordinary skill in the art upon review of the following detailed description of the exemplary embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
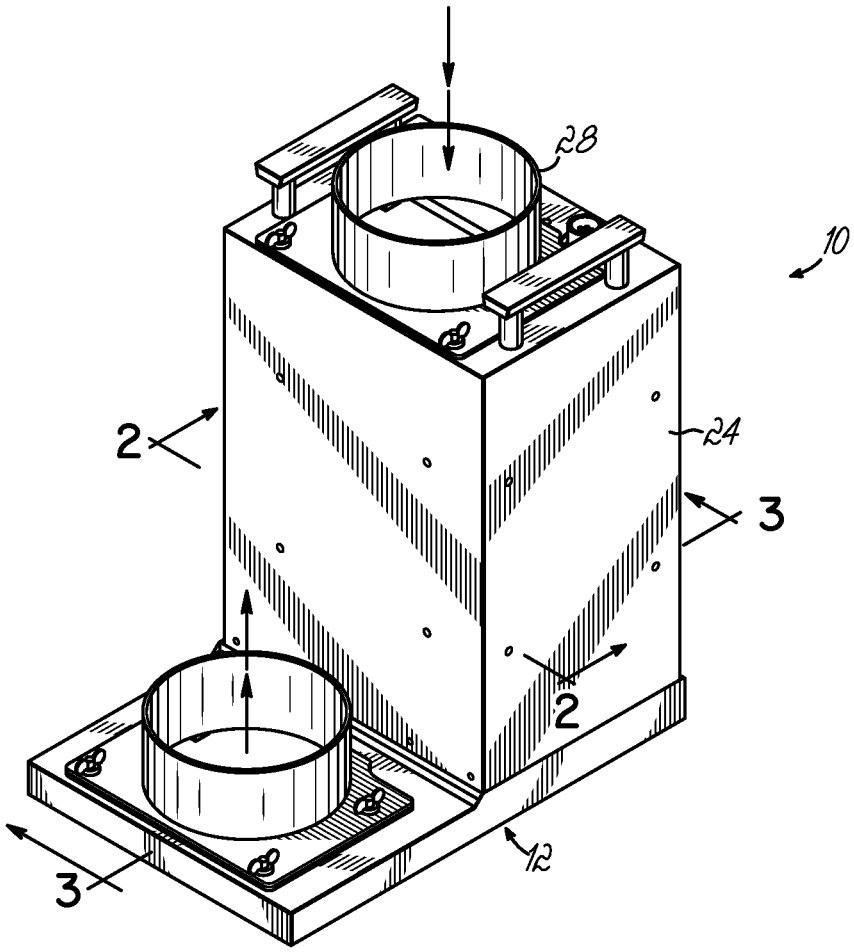
FIG. 1 is a perspective view of a microwave-excited ultraviolet lamp system, including an exhaust system, in accordance the principles of the present invention.
Figure 2:
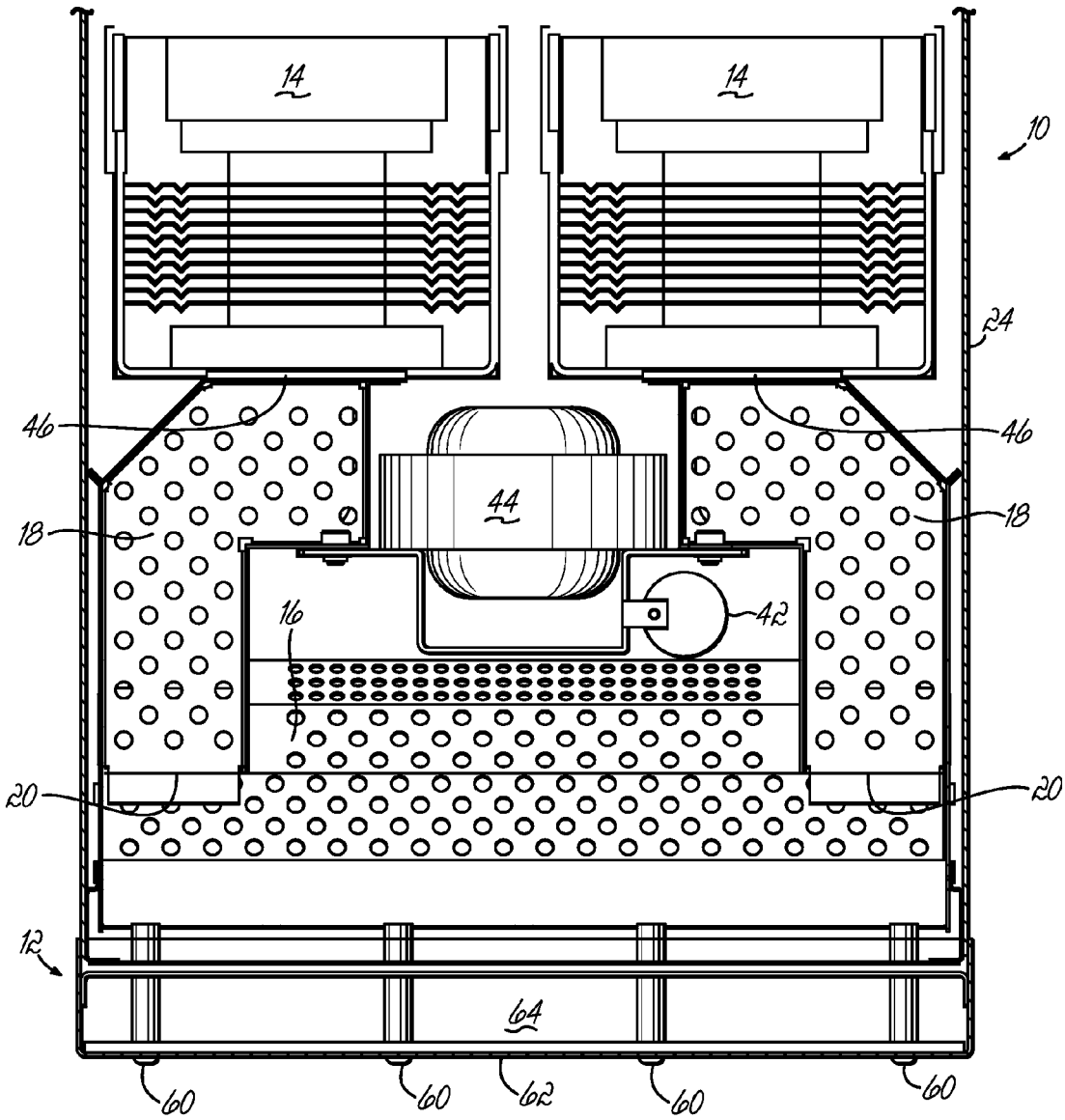
FIG. 2 is a cross-sectional view of the lamp system of FIG. 1, taken along line 2-2.
Figure 3:
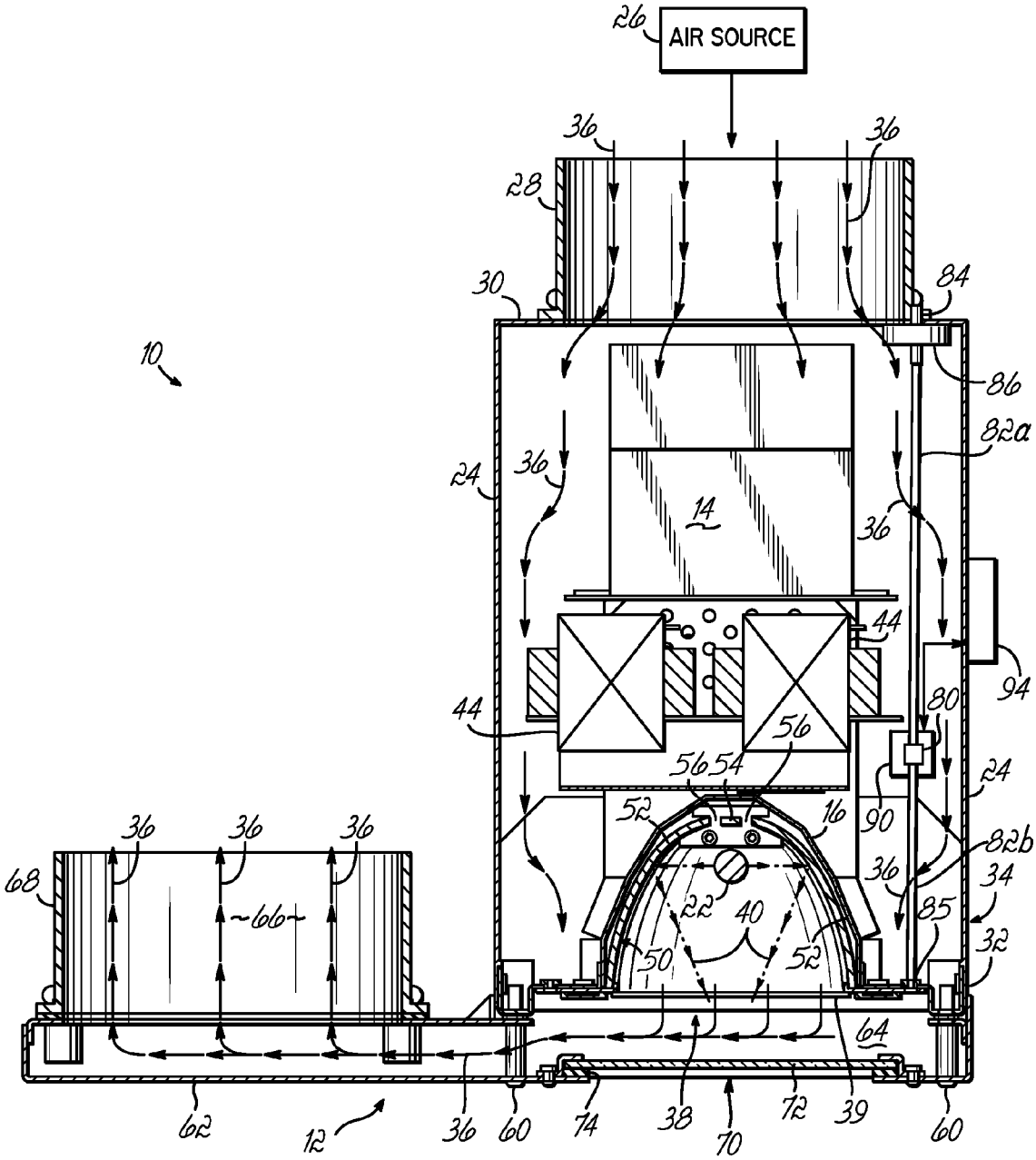
FIG. 3 is a cross-sectional view of the lamp system of FIG. 1, taken along line 3-3.

With reference to the FIGS. 1-3, a microwave-excited ultraviolet ("UV") lamp system 10 is shown, including an exhaust system 12 mounted thereto. Lamp system 10 includes a pair of microwave generators, illustrated as a pair of magnetrons 14 (FIGS. 2-3), that are each coupled to a longitudinally extending microwave chamber 16 through a respective waveguide 18 (FIG. 2).

Each waveguide 18 has an outlet port 20 (FIG. 2) coupled to an upper end of the microwave chamber 16 so that microwaves generated by the pair of microwave generators 14 are coupled to the microwave chamber 16 in spaced, longitudinal relationship adjacent opposite upper ends of the chamber 16. An electrodeless plasma lamp 22, in the form of a sealed, longitudinally extending plasma bulb, is mounted within the microwave chamber 16 and is supported adjacent the upper end of the chamber 16 as known in the art.

Lamp system 10 further includes a housing 24 that is connected in fluid communication with a source of forced air 26 through an air inlet duct 28 located at an upper end 30 of the housing 24. The lower end 32 of the housing 24 forms a lamp head 34 (FIG. 3). The source of forced air 26 is operable to direct cooling air, represented diagrammatically in FIG. 3 by arrows 36, through the housing 24 and into the microwave chamber 16 to cool the magnetrons 14 and plasma lamp bulb 22, as will be described in greater detail below. The cooling air 36 passes through the microwave chamber 16 and is emitted through an open lamp face 38 (FIG. 3) of the lamp head 34. The lamp head 34 may include a mesh screen 39 mounted over lamp face 38. The screen 39 is transparent to emitted ultraviolet radiation 40, but is opaque to microwaves generated by the magnetrons 14.

Lamp system 10 is designed and constructed to emit ultraviolet light, illustrated diagrammatically in FIG. 3 by arrows 40, through the open lamp face 38 of the lamp system 10 upon sufficient excitation of the plasma lamp bulb 22 by microwave energy coupled to the microwave chamber 16 from the pair of microwave generators 14. While a pair of magnetrons 14 are illustrated and described herein, it is to be understood that the lamp system 10 may include only a single magnetron 14 to excite the plasma lamp bulb 22 without departing from the spirit and scope of the present invention.

As shown in FIG. 2, lamp system 10 includes a starter bulb 42 and a pair of transformers 44 (one shown in FIG. 2) that are each electrically coupled to a respective one of the magnetrons 14 to energize filaments of the magnetrons 14 as understood by those skilled in the art. The lamp system 10 may be adapted to permit adjustment of a power setting of the magnetrons 14 to vary the power output by the plasma lamp bulb 22. The magnetrons 14 are mounted to respective inlet ports 46 (FIG. 2) of the waveguides 18 so that microwaves generated by the magnetrons 14 are discharged into the chamber 16 through the longitudinally spaced apart outlet ports 20 of the waveguides 18. Preferably, the frequencies of the two magnetrons 14 are split or offset by a small amount to prevent intercoupling between them during operation of the lamp system 10.

A longitudinally extending reflector 50 is mounted within the microwave chamber 16 for reflecting the ultraviolet light 40 emitted from the plasma lamp bulb 22 toward a substrate (not shown) that is located generally near the open lamp face 38 of the lamp head 34. In one embodiment, reflector 50 has an elliptical configuration in transverse cross-section, although parabolic or other cross-sectional configurations are also possible.

As shown in FIG. 3, reflector 50 includes a pair of longitudinally extending reflector panels 52 that are mounted in opposing, i.e., mirror facing relationship, within the microwave chamber 16 and in spaced relationship to the plasma lamp bulb 22. Each reflector panel 52 may be made of coated glass or other materials having suitable reflective and thermal properties. When the reflector panels 52 are made of coated glass, for example, each reflector panel 52 is transparent to the microwave energy generated by the pair of magnetrons 14 but opaque to and reflective of the ultraviolet light 40 emitted by the plasma lamp bulb 22.

Further referring to FIG. 3, a longitudinally extending intermediate member 54 is mounted within the microwave chamber 16 in spaced relationship to the reflector panels 52, and also in spaced relationship to the plasma lamp bulb 22. The intermediate member 54 may be made of glass, such as PYREX®, and may uncoated so that it is non-reflective of the ultraviolet light 40 emitted by the plasma lamp bulb 22.

When the pair of reflector panels 52 and the intermediate member 54 are mounted within the microwave chamber 16 to form the reflector 50, a pair of spaced, longitudinally extending slots 56 (FIG. 3) are formed between the reflector panels 52 and the intermediate member 54. The pair of spaced, longitudinally extending slots 56 are operable to pass cooling air 36 from the forced air source 26 toward the plasma lamp bulb 22 so that the cooling air 36 envelops the plasma lamp bulb 22 effectively entirely about its outer surface to cool the bulb 22. Details of the construction of the reflector 50 are more fully described in commonly owned U.S. Pat. No. 6,696,801, entitled "Microwave Excited Ultraviolet Lamp System With Improved Cooling", the disclosure of which is incorporated herein by reference in its entirety. Of course, other reflector configurations are possible as well as will be readily understood by those of ordinary skill in the art. The cooling air 36 thereafter passes through the microwave chamber 16 and is emitted through the open lamp face 38 of the lamp head 34.

As shown in FIGS. 1-3, the exhaust system 12 is mounted in fluid communication with the lamp head 34 so that cooling air 36 emitted from the open lamp face 38 is contained and directed within the exhaust system 12 so as not to contact the substrate (not shown) being irradiated. The exhaust system 12 is secured to the lower end 32 of the housing 24, for example by fasteners 60, and comprises an enclosed duct 62 having an air inlet port or plenum 64 (FIG. 3) configured to receive cooling air 36 emitted through the open lamp face 38, and an exhaust port 66 defined by exhaust duct 68 (FIG. 3) configured to direct the cooling air 36 to a location remote from the lamp head 34 so that the cooling air 36 does not contact the substrate (not shown).

As shown in FIGS. 1-3, air exhaust duct 68 is mounted to duct 62 generally in registry with the exhaust port 66. The exhaust duct 68 is fluidly connected to an air exhaust system (not shown) so that the cooling air 36 is contained and directed within the exhaust system 12 to an area where it will not contact and thereby possibly contaminate or disturb the substrate. While the exhaust system 12 has been depicted herein as having ductwork located beneath the open face 38 of the lamp head 34, with a generally vertically directed exhaust port 66, it ill be appreciated that the configuration and orientation of the exhaust port 66 and the exhaust duct 68 may have various other configurations, as may be desired.

As shown in FIGS. 2 and 3, duct 62 has an opening 70 formed therethrough and positioned generally in registry with the microwave chamber 16. A lens 72, such as a quartz lens, is mounted to the duct 62 and is positioned generally in registry with the opening 70. The lens 72 transmits the ultraviolet light 40 emitted through the lamp face 38 toward the substrate. A gasket 74 (FIG. 3) is positioned between a lower surface of the lens 72 and a bottom wall of the duct 62, generally about the opening 70 to provide a generally air tight seal therebetween. The quartz lens 72 is beneficial to reduce heat transfer to the substrate from the plasma lamp bulb 22 and also serves as an air shield to prevent the cooling air 36 emitted from the lamp face 38 from contacting the substrate.

UV lamp system 10 further includes a pressure sensor 80 positioned to sense a pressure associated with the cooling air 36 provided from air source 26 through housing 24. The sensed pressure is indicative of the flow rate of cooling air 36 through housing 24. In one embodiment, the pressure sensor 80 is a differential transducer configured to sense a difference in pressure between a location inside the lamp system 10 and atmospheric pressure. It will be recognized, however, that various other types of sensors adapted to sense a pressure associated with the flow of cooling air 36 may be used. In the embodiment shown in FIG. 3, differential pressure transducer 80 is mounted within the housing 24. A first sampling conduit 82*a* extends toward the upper end 30 of the housing 24 such that the upper end 84 of conduit 82*a* is exposed to atmospheric pressure. In the embodiment shown, the upper end 84 of the conduit 82*a* is secured by a mounting fixture 86 adjacent the upper end 30 of the housing 24 such that the end 84 extends through the housing 24. A second sampling conduit 82*b* extends toward the lower end 32 of housing 24 and has a lower end 85 mounted adjacent mesh screen 39 at the open face 38 of the lamp head 34. The pressure sensor 80 generates a signal related to the difference in pressure between the atmosphere and the cooling air flow inside housing 24 adjacent mesh screen 39. This differential pressure is related to the flow rate of the cooling air 36.

The lamp system 10 further includes a control 90 configured to govern operation of lamp system 10. The control 90 may receive signals from various sensors and/or other components of the lamp system 10, and is configured to coordinate the functions of the lamp system 10 based on the received signals. For example, the control 90 may receive signals related to the desired power setting for the lamp 22, whereby the control 90 is configured to adjust current supply to the transformers 44 to obtain the desired power output of the lamp 22. In the embodiment shown, the pressure sensor 80 communicates with the control 90 to provide a signal related to the sensed air pressure in plenum 64. The control 90 is further operatively coupled to the air source 26 and is configured to selectively adjust operation of the air source 26 to provide a desired flow rate of cooling air through inlet 28 to housing 24. The control 90 may be configured to adjust operation of the air source 26 such that the flow rate of cooling air is proportional to the sensed air pressure, or various other forms of control may be used to establish an adjusted flow rate of cooling air.

In one embodiment, the control 90 is configured to selectively adjust the flow rate of cooling air from air source 26 as a function of a desired power setting for the lamp 22. The pressure of the cooling air 36 is sensed by the pressure sensor 80 and is converted to a signal that is communicated to the control 90 to provide an indication of the actual air flow rate of the cooling air 36. Based on the signal from the pressure sensor 80, the control 90 may thereafter selectively adjust the flow rate of air from the air source 26 between a maximum value and a non-zero minimum value to obtain the desired flow rate corresponding to the power setting of the lamp 22. If the source of forced is a fan or blower, for example, control 90 may adjust the speed of the fan or blower to obtain the desired flow rate of cooling air. Because the rate of flow of cooling air can be selectively controlled, the lamp system 10 may be operated in a more efficient manner. In particular, the lamp 22 may be operated at lower power settings without overcooling.

Figure 4:
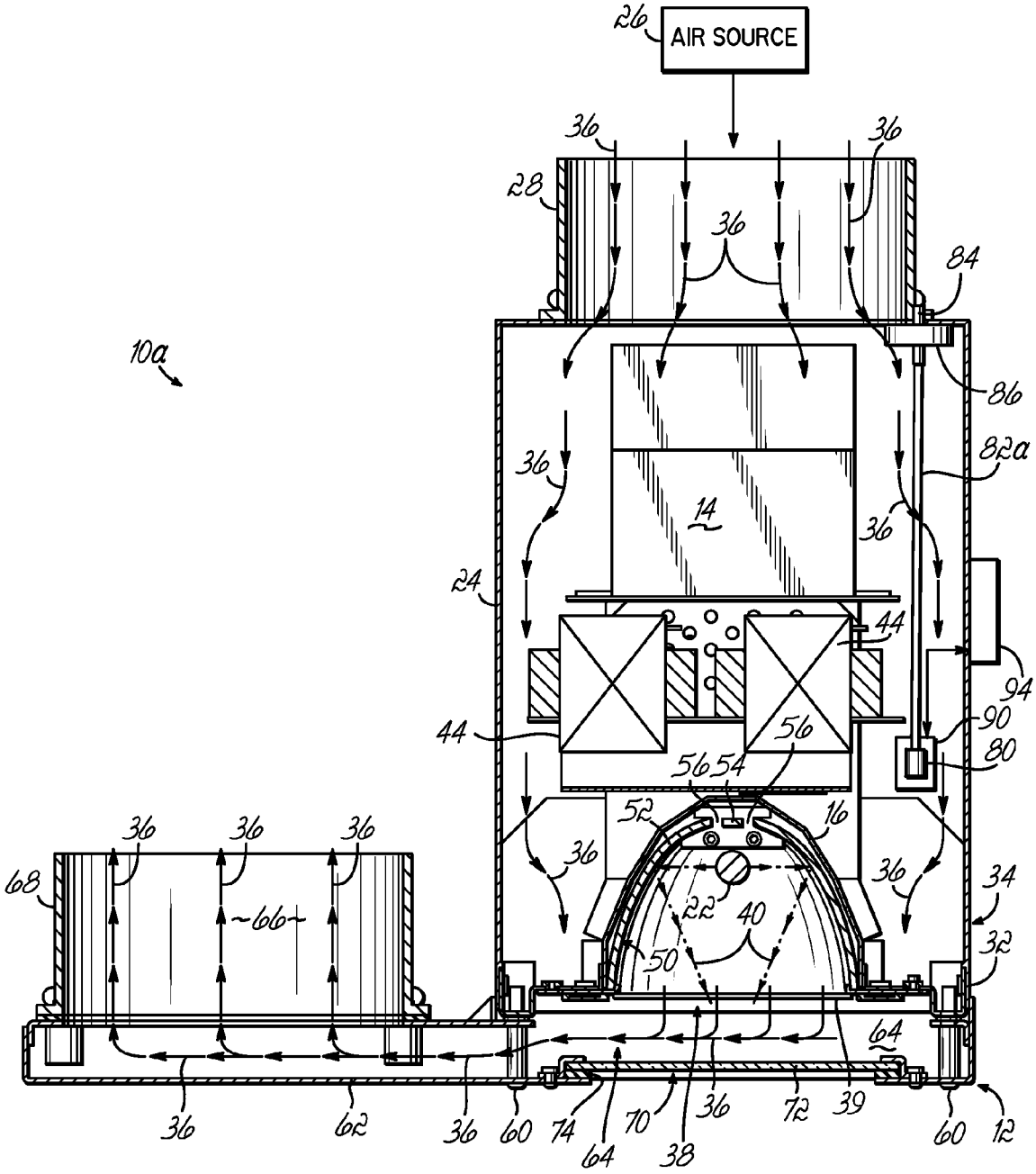
FIG. 4 is a cross-sectional view, similar to that shown in FIG. 3, and depicting an alternative embodiment in accordance with the principles of the present invention.

As cooling air 36 flows through the housing 24, the pressure of the air will drop as a result of flow losses in the system. While FIG. 3 depicts a differential pressure sensor 80 having a sampling conduit 82*b* with an end located adjacent mesh screen 39 for sampling pressure at that location, it will be recognized that the pressure may alternatively be sampled at various other locations within housing 24, for example, to better approximate the pressure near lamp 22. FIG. 4 depicts another embodiment of a UV lamp system 10*a* in accordance with principles of the present invention, wherein various components similar to those described above are similarly numbered. In FIG. 4, the pressure sensor 80 is positioned on or adjacent control 90 within the housing 24 and pressure is sampled directly at the sensor 80. Accordingly, no sampling conduit is required to sample the pressure at this location. First sampling conduit 82*a* coupled to the pressure sensor 80 has an upper end 84 positioned outside the housing 24 whereby the pressure sensor 80 is configured to generate signals corresponding to the differential pressure between the interior of the housing 24 and atmospheric pressure, as discussed above. The control 90 receives signals from the pressure sensor 80, which are related to the flow rate of the cooling air 36, discussed above. The control 90 may therefore adjust the flow rate of air from air source 26 provided to the housing 24 through inlet duct 28 to obtain a desired air flow, as discussed above.

Figure 5:
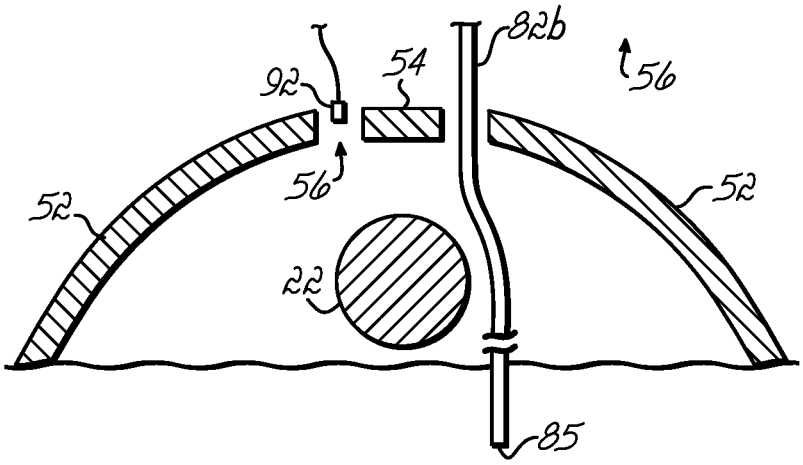
FIG. 5 is an enlarged cross-sectional view of the lamp system of FIG. 1, illustrating another embodiment in accordance with the principles of the present invention.

FIG. 5 depicts another embodiment wherein the lower end 85 of sampling conduit 82*b* from pressure sensor 80 is located within the housing 24 at a position adjacent the space 56 between a reflector panel 52 and the intermediate member 54. A signal from the pressure sensor 80 is communicated to the control 90, as discussed above, to facilitate adjustment of the flow rate of the cooling air 36 provided from air source 26 to obtain a desired flow rate substantially adjacent the lamp 22.

The lamp system 10 may further include a temperature sensor 92 configured to sense a temperature associated with the lamp system 10. In the embodiment depicted in FIG. 5, the temperature sensor 92 is positioned adjacent the space 56 between a reflector panel 52 and the intermediate member 54 whereby the temperature sensor 92 is able to sense a temperature substantially related to the temperature of the lamp 22.

Signals from the temperature sensor 92 may be communicated to the control 90 so that the control 90 may adjust the operation of the lamp system 10 as may be desired. For example, the control 90 may selectively adjust the flow rate of cooling air 36 from air source 26 as a function of the sensed temperature, or as a function of both the sensed temperature and the pressure signal generated by the pressure sensor 80. Alternatively, the control 90 may be configured to shut down the lamp system 10 when the flow rate of air as detected by the pressure sensor 80 reaches a predetermined value, or when the temperature sensed by temperature sensor 92 reaches a predetermined value.

Lamp system 10 may further include a display 94 communicating with control 90 and operable to display information related to the operation of the lamp system 10. For example, display 94 may indicate the cooling air flow pressure sensed by pressure sensor 80, the lamp temperature sensed by temperature sensor 92, or various other parameters related to the operation of the lamp system 10.

In another embodiment of the invention, a method of operating a microwave-excited ultraviolet lamp system 10 includes providing cooling air to a housing 24 of the lamp system 10, sensing a pressure associated with the cooling air, and adjusting a flow rate of the cooling air based on the sensed pressure. Adjustment of the flow rate may be carried out as a function of a power setting of the lamp system 10. The method may further include measuring a temperature associated with lamp system 10 and adjusting the flow rate of cooling air as a function of the sensed temperature, either alone, or in combination with the sensed pressure of the cooling air.

While the present invention has been illustrated by the description of one or more embodiments thereof, and while the embodiments have been described in considerable detail, they is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A microwave-excited ultraviolet lamp system, comprising:

a housing having an interior;

a microwave chamber within said housing interior;

a lamp bulb within said microwave chamber;

a source of forced air communicating with said housing interior and providing a flow of air thereto;

a pressure sensor configured to sense a pressure associated with said housing interior, said pressure sensor producing a signal associated with the pressure sensed by said pressure sensor; and a control receiving the signal from said pressure sensor and in response thereto, adjusting the flow rate of the air to a different, non-zero flow rate to maintain a desired spectrum of the lamp system.

2. The lamp system of claim 1, wherein said pressure sensor senses a differential pressure between said housing interior and atmospheric pressure.

3. The lamp system of claim 1, wherein said control adjusts the flow rate of the air to be proportional to the pressure sensed by said pressure sensor.

4. The lamp system of claim 1, further comprising a temperature sensor adapted to sense a temperature associated with the lamp system and to produce a signal related to the sensed temperature, and wherein said control receives said signal from said temperature sensor and adjusts the flow rate of the air as a function of the temperature sensed by said temperature sensor and the pressure sensed by said pressure sensor.

5. The lamp system of claim 1, wherein the lamp system is adjustable to vary a power setting of the lamp system, and wherein said control receives a signal related to the power setting of the lamp system and adjusts the flow rate of the air as a function of the signal related to the power setting in combination with said signal produced by said pressure sensor.

6. The lamp system of claim 1, wherein said control selectively adjusts the airflow over a range between a maximum value and a non-zero minimum value.

7. A method of operating a microwave-excited ultraviolet lamp system having a housing, comprising:

providing cooling air to the housing of the lamp system;

sensing a pressure within the housing and associated with the cooling air; and adjusting a flow rate of the cooling air to a different, non-zero flow rate based on the sensed pressure to maintain a desired spectrum of the lamp system.

8. The method of claim 7, wherein the lamp system is adjustable to vary a power setting of the lamp system, the method further comprising:

adjusting the flow rate of the cooling air as a function of the power setting of the lamp system in combination with the sensed pressure.

9. The method of claim 7, further comprising:

sensing a temperature within the housing; and adjusting the flow rate of the cooling air to a different, non-zero flow rate based on both the sensed pressure and sensed temperature.

* * * * *